United States Patent [19]

Henig

[11] Patent Number: 5,015,302

[45] Date of Patent: May 14, 1991

[54] SYSTEM AND METHOD FOR RECOVERING AND RECYCLING OF ADHERING SURFACE-TREATMENT SOLUTIONS FROM BARRELS AND THEIR LOADS

[76] Inventor: Hans J. Henig, Albrecht-Achilles-Str. 48, Nürnberg, Fed. Rep. of Germany, 8500

[21] Appl. No.: 486,376

[22] Filed: Feb. 28, 1990

[51] Int. Cl.[5] ..... B08B 5/02; B08B 7/04

[52] U.S. Cl. ..... 134/25.4; 134/33; 134/37; 134/135; 134/199; 134/200; 34/130; 34/136; 34/137; 15/305

[58] Field of Search ..... 134/25.4, 30, 33, 37, 134/135, 199, 200; 15/305; 204/213; 34/130, 131, 135, 136, 137

[56] References Cited

U.S. PATENT DOCUMENTS 4,469,526 9/1984 Budinsky et al. ..... 134/25.4

*Primary Examiner*—Theodore Morris
*Assistant Examiner*—S. Chaudhry
*Attorney, Agent, or Firm*—Fleit, Jacobson, Cohn, Price, Holman & Stern

[57] ABSTRACT

A system and method for removing drag-out adhering surface treating solutions from barrels and their loads of articles in bulk after electroplating and/or chemical surface treatments and the recovery (recycling) of said solutions. The system includes a barrel aggregate (5) for containing the load of articles (7) being treated, a device for moving the barrel between a position inside treatment container (1) and outside of and above the container which is filled with a treatment solution, a rigid half cylinder shell (2', 2") for partically embracing the barrel in its outside position above the container so that the half cylinder shell embraces only that upper part of the barrel which is not filled with the load, and a device (9) for supplying inside the half cylinder shell a stream of pressured air flowing first through the upper part of the barrel and in continuation through the load downwardly out of the barrel to remove the adhered drag-out solution from the barrel and load to flow directly back to the container.

20 Claims, 2 Drawing Sheets

SYSTEM AND METHOD FOR RECOVERING AND RECYCLING OF ADHERING SURFACE-TREATMENT SOLUTIONS FROM BARRELS AND THEIR LOADS

BACKGROUND OF THE INVENTION

The present invention relates to a system and a method for removing adhering surface-treating aqueous solutions from barrels and their loads of articles in bulk after electroplating and/or chemical surface treatments and the recovery of the solutions. More particularly, the invention relates to a system and a method for removing adhering surface-treating aqueous solutions from barrels and their loads of articles in bulk after electroplating and/or chemical surface treatments and their recovery with conveying means, traveling hoisting carriages, treatment stations, barrel aggregates with perforated walls, solution containers and connected tubular conduits.

Systems and methods for removing adhering surface treating aqueous media from objects and their recovery are known. This recovery is particularly required in connection with surface treatment procedures for loads of articles in bulk processed in so-called plating barrels. Such barrels and their loads drag out considerable quantities of treatment solutions which are drastically diluted in subsequent water rinsing steps (up to ratios of 1:1000 and more), and thereby nullified as a chemical solution to be used again. Further, the contaminated rinsing waters have to be supplied to decontaminating waste water treatment systems, thereby causing additional high expenses. Conventional stand rinse baths are used to compensate evaporation losses of high temperature treatment solutions. Even in such exceptional cases the main part of the drag-out quantities has to be decontaminated in waste water treatment systems. The object of the German Offenlegungsschrift No. 2,758,550 has a different proposal for reducing the previously mentioned disadvantages. This system partially removes the drag-out quantity of treatment solution by aspiration. The aspiration process has to be separately performed in an additional station of the plating plant directly attached to the tank containing the treatment solution and it must be arranged with means resupplying continuously via conduits the aspirated liquid medium into its original container.

U.S. Pat. No. 4,469,526 presents another proposal to solve the above mentioned problem. The barrel aggregate containing the load of articles in bulk is lifted above the container filled with the treatment solution. Two semicircular shells placed on a traveling carriage move horizontally and embrace completely the barrel forming a closed circular chamber all around the barrel. A small gap remains open at the bottom between both semicircular halves of the chamber. Pressurized gas (air) and rinsing water are alternately and periodically supplied to said chamber. A gas stream is blown through said narrow gap so that adhered treating solution is removed from the load and the barrel areas which are mainly around the gap and flows directly back to the container through said gap. The disadvantages of this system are obvious. The restricted zone around the gap from which the treatment solution is withdrawn results in a low efficiency of the system. The movement sequence of both semicircular chamber halves has to be program controlled in accordance with the barrel hoisting and lowering as well as with the alternately and periodically processed gas blowing and water rinsing steps. The guiding and supporting mechanism mounted on the carriage for the programmed movements of both semicircular chamber halves is complicated, heavy, difficult to maintain and, consequently, expensive. Furthermore, the lower inside regions of both chamber halves are covered by the blowing and rinsing steps with partially diluted treatment solutions. The remains of the solutions on the lower chamber halves will drip during the carriage movements along the plating plant into the different containers with different treatment solutions and contaminate or distabilize them.

BRIEF SUMMARY OF THE INVENTION

The object of the present invention is to improve upon known systems of removing adhering surface-treating aqueous solutions from a barrel and its load of articles in bulk and to eliminate the disadvantages of those systems.

A further object of the invention is to provide a system and a method of removing the adhered treatment solutions from the barrel and load and their direct recovery by returning the solutions into their original containers.

Corresponding to the above mentioned accomplishments, the invention features a novel combination of basic equipment construction elements. It includes a working container filled with a surface-treating solution, a barrel aggregate movable between two positions inside and outside said container and accommodating a load of articles in bulk to be treated, a rigid half of cylinder shell for partial embracing said barrel in its outside position so that said half cylinder embraces only that upper part of the barrel which is not filled with said load and the means for supplying inside the half cylinder shell an air stream flowing first through the upper part of the barrel and in continuation through the barrel load downwards out of the barrel, whereby, the flowing through air stream removes the adhered remains of the treatment solution from the barrel and its load directly into the container located below that barrel.

The half cylinder shell corresponding to the invention is mounted to a traveling hoisting carriage of the plant which incorporates several containers filled with different treatment solutions and rinsing water in accordance with the required surface treatment process. The rigid half cylinder shell is fixed on the mechanical structure of the carriage. Consequently, in regard to the carriage, the half cylinder shell doesn't change its position in a vertical or in a horizontal direction. This condition of mechanical immobility, in respect to the carriage system, doesn't vary, even if the half cylinder shell consists of one, two or more assembled construction elements.

An additional, and particularly advantageous feature of the invention comprises an elongated rectangular segment which is rotationally mounted on one of its longitudinal sides on one longitudinal bottom edge of the rigid half cylinder shell and oscillates from a vertical position when the barrel is outside the shell to a diagonally inclined position towards the barrel when the barrel is positioned inside the shell. The inclined rotational segment unilaterally touches the barrel directing the main air stream straight through the middle portion of the barrel load, thereby substantially improving the efficiency of the solution removing action.

The barrel is an integral part of the system and it consists mainly of a prismatic or cylindrical perforated shell with reinforcing longitudinal ribs, a door with a locking device to load or unload the articles in bulk which have to be treated, and two attached end walls. The barrel and rigid half cylinder shell are provided with rotation-symmetrical cross sections which are placed concentrically so close together that they touch. The barrel periphery (especially its longitudinal reinforcing ribs) will slide alongside the interior part of the half cylinder shell, directing the stream of pressurized air to pass through the barrel and its load.

Furthermore, the rotating rectangular segment attached at one of the longitudinal bottom edges of the cylindrical shell can be provided with a circular cross section adapted to the rotation-symmetrical periphery of the barrel producing an additional improvement of the system's efficiency by leading the stream of pressurized air entirely through the barrel and the load.

The method to operate the removing and recovering of the adhering drag-out solution from the barrel and its load is also an integral part of the present invention. The method comprises the steps of accommodating the load of articles in bulk in a barrel aggregate, lowering the barrel into a container filled with an aqueous surface-treating solution so as to contact the load with the solution, lifting the barrel aggregate out of the container after treating the load in the solution, introducing the barrel inside the rigid half cylinder shell mounted on the traveling carriage so that the barrel touches the shell, turning the rotationally mounted rectangular segment toward the barrel, blowing a stream of pressurized air through the upper part of the barrel which is not filled with the load and in continuation through the load downwards out of the barrel so as to remove the solution and cause it to flow directly back into the container.

Another invention feature concerns the step of rotating the barrel aggregate continuously or intermittently during the period of blowing a stream of pressurized air through the barrel and its load.

The main construction elements of the system, the barrel aggregate and the rigid half cylinder shell, are preferably made of a synthetic plastic material, for example, polypropylene. The various features of the invention will be apparent from the following description of exemplified embodiment, drawings and claims. The scope of the invention is not limited to the object of the drawings itself, as the drawings are only for the purpose of illustrating ways in which the basic principles of the invention can be applied. Other embodiments of the invention utilizing the same or equivalent principles may be employed and structural changes may be made by those skilled in the art without departing from the present invention and the purview of the appended claims.

BRIEF DESCRIPTION OF THE DRAWINGS

The invention will now be described in detail with reference to the accompanying drawings wherein.

DESCRIPTION OF A PREFERRED EMBODIMENT

Figure 1:
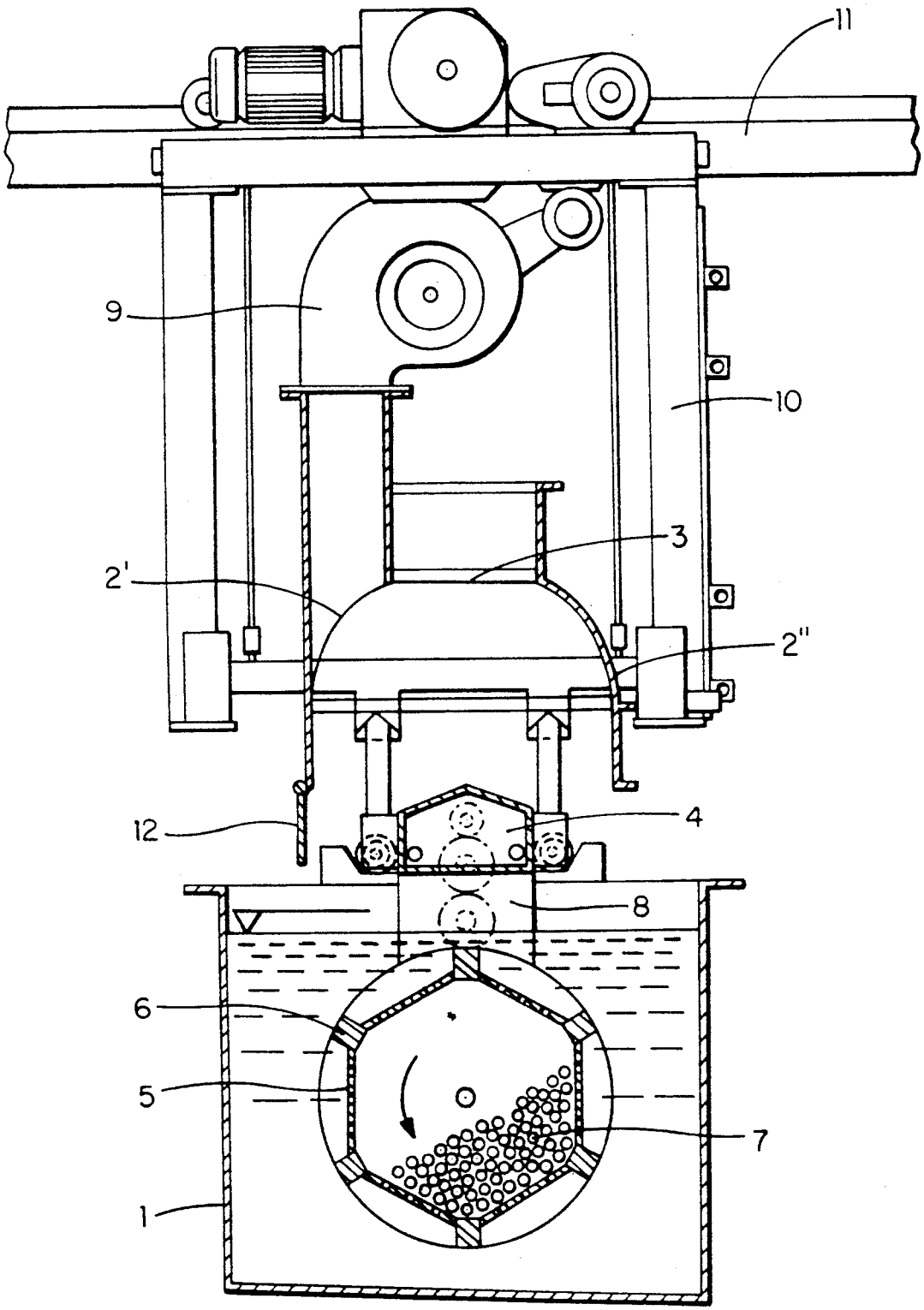
FIG. 1 is a vertical, axial cross-sectional and part schematic view of the system of the invention for recovering adhering surface treatment solutions from barrels and their loads with the barrel submerged in an aqueous solution, which is in the container below a traveling hoisting carriage.

The system for removing the dragged out adhering solution from the barrel and its load has a working container 1 filled with the solution. It serves as a bath in a line of several process-related different surface treatment solutions.

The rigid half cylinder shell, marked by the reference numbers 2' and 2'', is made of a synthetic plastic material and can be additionally reinforced with shaped construction elements corresponding to higher demands of mechanical stability. The exemplified half cylinder shell consists of two components, 2' and 2'', each of them having approximately the shape of a quarter of a circle. Both circle quarters 2' and 2'' are separated by a gap marked with the number 3 providing the needed space to introduce the super structure 4 of the hexagonal barrel 5 in between the two quarters.

The barrel consists mainly of a prismatic or cylindrical perforated shell with reinforcing longitudinal ribs 6, a door (not shown) with a locking device to load or unload the articles which have to be treated, and two attached end walls. The load 7 of articles in bulk inside the barrel 5 fills up about one third of the barrel's inner volume. The barrel 5 rotates continuously during the treatment period while submerged in the solution of the container 1. The corresponding arrow in FIG. 1 indicates the counter-clockwise direction of the rotation. Furthermore, the barrel 5 is arranged between two hanger arms 8 of the superstructure 4.

The cross section of the barrel 5, including the ribs 6 on its periphery, as well as the two attached end walls, have a rotation symmetrical form.

Figure 2:
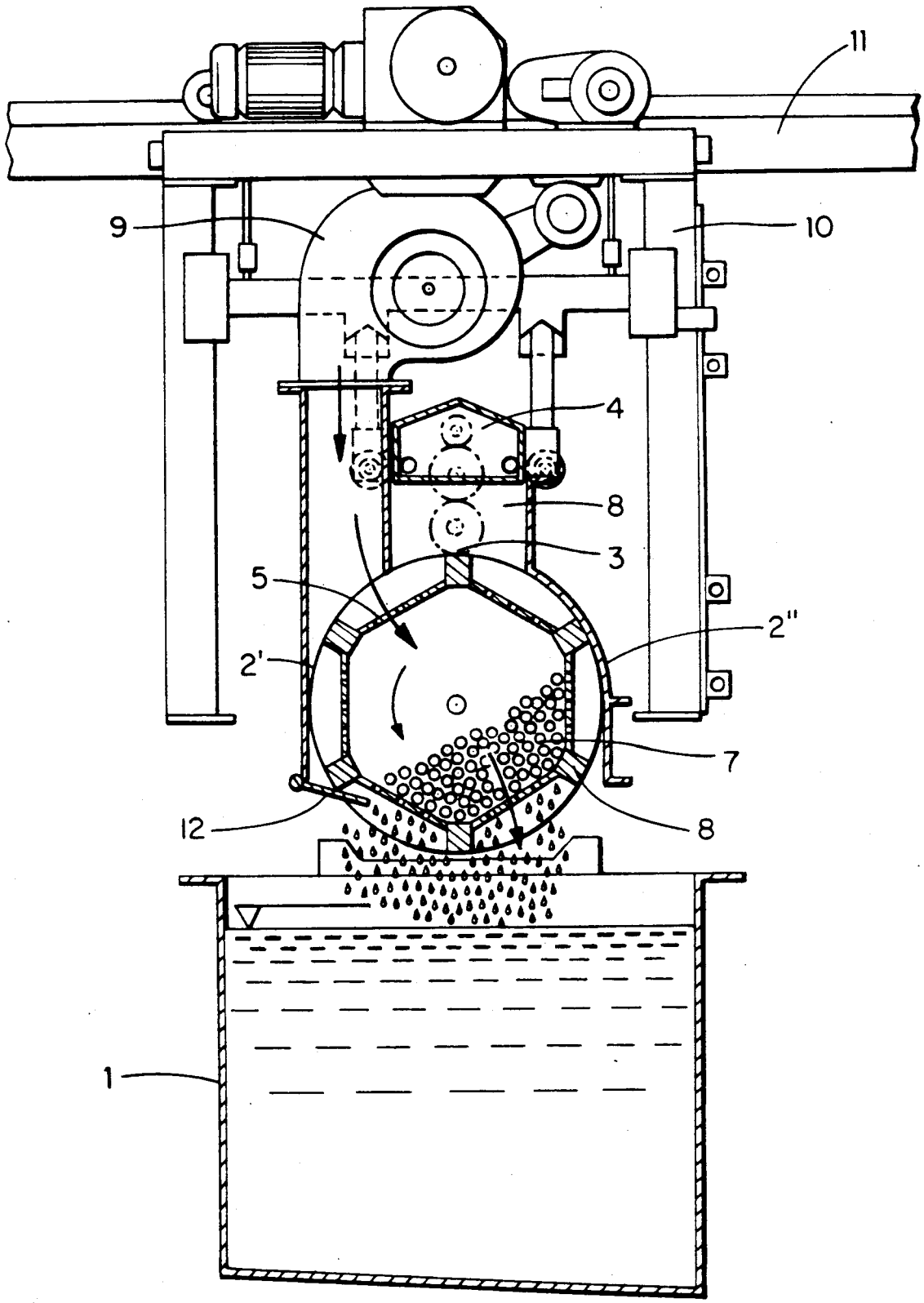
FIG. 2 is a view similar to FIG. 1 of the same barrel plant represented in FIG. 1 showing the barrel lifted in an operative position to the position inside the half cylindrical shell mounted on the carriage.

FIG. 2 displays the barrel 5 in its lifted operational position inside the rigid half cylinder shell 2' and 2''. The geometrical shape of said shell 2' and 2'' is also rotation-symmetrical. Both construction elements of the invention, the lifted barrel 5 and the half cylinder shell 2' and 2'', are concentrically placed during the operational period of removing the drag-out solution. The inner periphery (diameter) of the rigid half cylinder shell 2' and 2'' corresponds exactly to the outer peripheral contour (diameter) of the rotation-symmetrical barrel 5, providing a sealing realized by the narrow touching connection between the two mentioned construction elements.

The fan 9 is mounted together with the half cylinder shell 2' and 2'' on the hoisting carriage 10 supplying the needed pressurized air to the barrel 5. The row of three arrows in FIG. 2 indicates the itinerary of the air stream coming from the fan 9, blown through the upper part of the barrel 5 which is not filled with the load 7 and in continuation passing through the load 7 downwards, out of the barrel 5 so as to remove the drag-out treatment solution and flow directly back into the container 1 below the barrel 5. The removing step can be performed with a continuously or intermittently rotating barrel 5 over a time period of approximately 20 seconds. The air stream originated from the fan 9 has a relatively low pressure of about 0.3 bar and a corresponding blowing capacity of 800 cubic meters per hour.

The traveling and hoisting carriage 10 lowers the barrel 5 into the solution of the container 1 and lifts it in its operational position above container 1. The carriage 10 also transfers the barrel 5 and its load 7 from one treatment station represented by the container 1 to a variety of other stations of the same plant. The carriage 10 moves along the track 11.

The timing and sequencing of steps concerning the removal of the solutions from the barrel 5 and its load 7 and their return to their initial containers 1 represent as a method an integral part of the invention showing how to operate the system in a most efficient way. The carriage 10 transfers the barrel aggregate 5 and its load 7 from a treatment station of the plant to the next one and lowers it into the solution of container 1. After completing the treatment step, the hoisting carriage 10 lifts the barrel 5 and introduces it inside the rigid half cylinder shell 2' and 2'' mounted on it. The fan 9 blows a stream of pressurized air through the barrel 5 and its load 7. Subsequently, the carriage 10 moves the barrel aggregate 5 to the following treatment container 1 to repeat the same functional sequence of operational steps.

The rigid half cylinder shell 2' and 2'' is fixed on the mechanical construction of the hoisting carriage 10 and doesn't change its position in respect to said construction. Consequently, the half cylinder shell 2' and 2'' moves neither vertically nor horizontally during the whole sequence of the previously mentioned operational steps. The two quarters 2' and 2'' make up the half cylinder shell as parts belonging together without changing the width of the gap 3 between them.

The half cylindrical shell 2' and 2'' tightly embraces only the upper half part of the barrel 5, which is not filled with the load 7. The stream of air passing through the barrel 5 and its load 7 generally evacuates 80% of the drag-out treatment solution during a regular blowing time period of approximately 20 seconds.

Furthermore, the invention increases the efficiency of the system by adding an elongated rectangular segment 12, which is rotationally mounted on one of its longitudinal sides along one of the longitudinal bottom edges of the rigid half cylinder shell 2' or 2''. The barrel 5 usually rotates at 8 revolutions per minute and partially moves the load 7 upwards as shown in FIG. 2. As long as the barrel 5 is out of the half cylinder shell 2' and 2'' the additional rotational segment 12 remains in a vertical position as shown in FIG. 1. As soon as the barrel 5 is introduced into and partially embraced by the half cylinder shell 2' and 2'', the rotational segment 12 oscillates from its vertical position to a diagonal one towards the barrel 5 and touches it (corresponding to FIG. 2). The unilaterally positioned segment 12 directs the air stream straight and almost entirely through the load 7, maximizing the efficiency of the system. The removal time of the treating liquid medium is thereby drastically reduced.

The system as well as the method of the invention are suitable for all chemical and electrolytical surface treatment processes such as acid or alkaline cyanide zinc, bright nickel, copper, and especially, for electroplating of the so-called precious metals (gold, silver, rhodium, cobald, palladium and their alloys).

A particular advantage of the inventive method concerns the recovery of drag-out treatment solutions and their direct return (their recycling) unchanged in concentration and composition to their original containers 1 of departure. The consumption of rinsing water is substantially reduced and the extensive recycling of the drag-out treatment solutions discharges the waste water plant, providing all the economical advantages and favorable consequences for environmental protection.

While the invention has been illustrated and revealed as in an exemplified system and method for recovering the drag-out treatment solutions and the recycling of the removed solutions back to their initial containers, it may be pointed out that the present invention isn't limited to the specific embodiment shown, since various modifications and applications may be made without departing in any way from the basic invention.

What is claimed as new and desired to be protected by Letters Patent is set forth in the appended claims.

I claim:

1. A system for removing adhering surface-treating aqueous solution from a barrel and its load of articles in bulk after electro-plating and/or chemical surface treatment and recovery of said solution, comprising:

a container for said solution;

a barrel aggregate for containing said load;

means for moving said barrel aggregate between a position inside said solution container and a position outside of and above said solution container;

a substantially half cylinder shell for partially embracing said barrel aggregate in said outside position so that said shell embraces substantially only that upper part of said barrel which is not filled with said load, said shell being stationary with respect to said barrel aggregate in any position thereof; and means for supplying a stream of pressurized air flowing through said substantially half cylinder shell into said upper part of said barrel aggregate and in continuation through said load downwardly and out of said barrel aggregate for removing the adhered treating solution from said barrel aggregate and load and directly flowing the solution back to said container.

2. A system as claimed in claim 1, and further comprising:

means for moving said substantially half cylinder shell between a plurality of treatment stations including a travelling hoisting carriage operatively connected to said shell.

3. A system as claimed in claim 1, wherein:

said substantially half cylinder shell has a lateral longitudinal edge; and a rectangular segment having a longitudinal side is rotationally mounted by said longitudinal side on said lateral longitudinal edge of said shell for swinging movement from a vertical position when said barrel aggregate is outside said shell to a diagonally inclined position towards said barrel aggregate to cover an additional part of said barrel when said barrel aggregate is positioned inside said shell.

4. A system as claimed in claim 1, wherein:

said substantially half cylinder shell comprises a two piece rigid assemblage.

5. A system as claimed in claim 1, wherein said barrel aggregate comprises:

a longitudinal prismatic or cylindrical perforated shell having a symmetrical cross section;

reinforcing longitudinal ribs;

a door with a locking device; and two attached end walls.

6. A system as claimed in claim 1:

said substantially half cylinder shell and said barrel have substantially concentric rotation-symmetrical cross sections.

7. A system as claimed in claim 6, wherein:

said barrel when positioned inside said substantially half cylinder shell contacts said shell.

8. A system as claimed in claim 3, wherein:

said rectangular segment has a substantially circular segment cross section adapted to substantially conform to the contour of said barrel.

9. A system as claimed in claim 1, wherein said substantially half cylinder shell and said barrel are made of synthetic plastic material.

10. A method of removing an adhering surface-treating aqueous solution from a barrel and a load of articles in bulk in the barrel after electro-plating and/or chemical surface treatment of the load in the solution in a container and recovery of said solution, comprising:

providing a substantially half cylinder shell above the container having a shape and size for partially receiving said barrel so that substantially only the upper part of the barrel which is not filled with the load is received in the shell;

providing a substantially rectangular segment rotatably mounted on said shell;

placing a load of articles in bulk in a barrel aggregate;

lowering the barrel aggregate into a container of said solution so that the load is in contact with said solution;

lifting the barrel aggregate out of said container after treating the load in the solution;

introducing the barrel aggregate inside said substantially half cylinder shell so that said barrel touches said shell;

turning said rotatably mounted segment towards said barrel to cover an additional part of the barrel and reduce the air outlet area thereof; and blowing a stream of pressurized air through at least a part of said shell and through the upper part of said barrel which is not filled with said load and in continuation through said load downwardly and out of said barrel to remove said solution from the barrel and load therein and cause the solution to flow directly back to said container.

11. As method as claimed in claim 10, and further comprising:

rotating said barrel aggregate during said air stream blowing step.

12. A method as claimed in claim 11, wherein said rotating step comprises intermittently rotating said barrel aggregate during said air stream blowing step.

13. A system as claimed in claim 5, wherein:

said substantially half cylinder shell comprises a two piece rigid assemblage.

14. A system as claimed in claim 5:

said substantially half cylinder shell and said barrel have substantially concentric rotation-symmetrical cross sections.

15. A system as claimed in claim 13:

said substantially half cylinder shell and said barrel have substantially concentric rotation-symmetrical cross sections.

16. A system as claimed in claim 3, wherein:

said substantially half cylinder shell comprises a two piece rigid assemblage.

17. A system as claimed in claim 16, wherein said barrel aggregate comprises:

a longitudinal prismatic or cylindrical perforated shell having a symmetrical cross section;

reinforcing longitudinal ribs;

a door with a locking device; and two attached end walls.

18. A system as claimed in claim 17:

said substantially half cylinder shell and said barrel have substantially concentric rotation-symmetrical cross sections.

19. A system as claimed in claim 18, wherein:

said barrel when positioned inside said substantially half cylinder shell contacts said shell.

20. A system as claimed in claim 19, wherein:

said rectangular segment has a substantially circular segment cross section adapted to substantially conform to the contour of said barrel.

* * * * *